US006886796B1

(12) United States Patent
Elander

(10) Patent No.: US 6,886,796 B1
(45) Date of Patent: May 3, 2005

(54) ELASTIC CORD STORAGE DEVICE

(76) Inventor: Donald Elander, 55825 Church St., Calumet, MI (US) 49913

( * ) Notice: Subject to any disclaimer, the term of this patent is extended or adjusted under 35 U.S.C. 154(b) by 0 days.

(21) Appl. No.: 10/369,302

(22) Filed: Feb. 19, 2003

(51) Int. Cl.[7] ..... B25H 3/00
(52) U.S. Cl. ..... 248/339; 248/304; 211/70.6
(58) Field of Search ..... 248/339, 304; 206/49, 349, 388, 461, 462, 493, 806; 211/70.6

(56) References Cited

U.S. PATENT DOCUMENTS 4,359,158 A * 11/1982 Gringer ..... 206/349
D288,533 S * 3/1987 Jialanella et al. ..... D9/415
4,872,551 A * 10/1989 Theros ..... 206/349
5,595,295 A * 1/1997 Lin ..... 206/349
5,695,161 A * 12/1997 Brozak, Jr. ..... 248/215
5,785,174 A * 7/1998 Chow ..... 206/349
5,788,303 A * 8/1998 Chia-Hsiang ..... 294/143
5,996,817 A * 12/1999 Kao ..... 211/70.6
6,049,950 A * 4/2000 Cavallo ..... 24/68 CD
6,247,675 B1 * 6/2001 Askin ..... 248/214
6,375,005 B1 * 4/2002 McCann ..... 206/349
6,378,700 B1 * 4/2002 Tong ..... 206/376
6,516,920 B1 * 2/2003 Schafler ..... 182/70
6,536,611 B2 * 3/2003 Chen ..... 211/70.6

* cited by examiner

*Primary Examiner*—Ramon O. Ramirez
*Assistant Examiner*—Ingrid Weinhold
(74) *Attorney, Agent, or Firm*—Michael I. Kroll

(57) ABSTRACT

A storage device for elastic straps comprising a resilient housing having an interior partition to form two separate compartments into which the hooks affixed to the ends of elastic cords are placed for suspension from a peg or other such hanging device for the purpose of preventing the hooks of the elastic cords from getting tangled with other cords or objects. A resilient support member protrudes from a side-wall in each compartment to retain the hook members therein. The hook members cannot pass beyond the support member unless adequate force is applied to temporarily deform said support member and housing to allow for the passage therethrough. A means for suspending the housing member from a peg or hook is included on the upper portion of said housing member. The device of the present invention may also be constructed with a single storage compartment.

11 Claims, 8 Drawing Sheets

ELASTIC CORD STORAGE DEVICE

BACKGROUND OF THE INVENTION

Field of the Invention

The present invention relates generally to storage devices and, more specifically, to an elastic cord storage device.

The present invention provides means for protecting the hooks ends of elastic cords to prevent entanglement. More specifically, a rubberized cap forming a housing is placed over a bungee style elastic cord hook member providing means to keep the hook end enclosed.

Furthermore, the rubberized cap forming a housing can have one or more compartments with a partition separating compartments. Each compartments has a cantilevered support member attached to one wall and its distal end spaced away from the opposing wall a predetermined distance of less than the diameter of the cross section of the hook material.

The rubberized cap is open ended to allow the bungee style elastic cord to be inserted within the housing. The elastic cord is held in place by means of a wedge support that is molded on the inner wall of the housing.

The wedge is triangular in shape and allows for the elastic cord hook to be slid into the cap housing and along the edge of the wedge. When the elastic cord hook is in proper position, it is supported by the upper surface of the wedge and held within the housing of the cap.

The wedge support is made up of a flexible rubberized material that allows the elastic cord hook to be removed from the cap housing with little force, but is rigid enough to hold the elastic cord hook in place while in a stored position.

The opposite end on the open-ended housing includes an extension that has an aperture. The aperture in the extension allows the elastic cord storage device to be suspended from a post support.

An embodiment of the present invention provides a cap housing that includes one compartment. The intention of this embodiment is to support one distal end of a bungee style elastic cord and allow the opposite distal end to hang freely.

This embodiment includes all other features of the present invention, including the wedge support means and the extension with an aperture that allows the elastic cord storage device to be suspended from a post.

DESCRIPTION OF THE PRIOR ART

There are other elastic cord storage devices. Typical of these is U.S. Pat. No. 1,058,925 issued to Ludolf Toegel, on Apr. 15, 1913.

Another patent was issued to G. A. Berglund on Jun. 2, 1925 as U.S. Pat. No. 1,540,244. Another patent was issued to R. L. Drew on Apr. 28, 1936 as U.S. Pat. No. 2,038,781. Yet another U.S. Pat. No. 4,123,012 was issued to W. Colton Hough on Oct. 31, 1978 and still yet another was issued on Aug. 14, 1990 James R Helseth as U.S. Pat. No. 4,948,202.

Another patent was issued to Tracy H. Schooley on Aug. 18, 1992 as U.S. Pat. No. 5,139,208. Yet another U.S. Pat. No. 5,278,428 was issued to Kuo-Hsing Lee on Jan. 18, 1994. Another was issued to David G. Maynard on Oct. 1, 1996 as U.S. Pat. No. 5,560,564 and still yet another was issued on Dec. 8, 1998 to Berkeley D. Dunnavant, Jr. as U.S. Pat. No. 5,845,787.

Another patent was issued to Richard A. Davis on Jan. 4, 2000 as U.S. Pat. No. 6,010,105. Yet another U.S. Pat. No. 6,099,060 was issued to William J Towers on Aug. 8, 2000. Another was issued to Bruce A. Glass on Mar. 27, 2001 as U.S. Pat. No. 6,206,318.

U.S. Pat. No. 1,058,925

Inventor: Ludolf Toegel

Issued: Apr. 15, 1913

This invention relates to reels and more particularly to reels for holding lines, rope and the like. The object of this invention is to provide a reel which is simple of construction, which will hold the line from unwinding itself and which, at the same time, will permit winding and unwinding the line with east and rapidity.

U.S. Pat. No. 1,540,244

Inventor: G. A. Berglund

Issued: Jun. 2, 1925

This invention relates to improvements in clothes line reels. One object of this invention is the provision of a reel of this character which shall embody novel means through the medium of which one end of the clothes line may be readily and quickly secured to or disconnected from the reel. This invention embodies a novel handle by means of which the reel may be held against casual movement during the winding of the clothesline thereon or during the unwinding of the clothesline therefrom.

U.S. Pat. No. 2,038,781

Inventor: R. L. Drew

Issued: Apr. 28, 1936

This invention provides a combined displaying and dispensing device for linear articles. More especially it provides for assembling and exhibiting a variety of specimens, of rope, for example, in mutually comparative relation, each specimen being intact with the coil or other supply of its particular variety which is being offered for sale, which usually is a mass of considerable and cumbersome bulk. It also provides so that the customer in making his selection may take the actual sample which he chooses, as a part of the desired length of that article, measured directly in the apparatus.

U.S. Pat. No. 4,123,012

Inventor: W. Colton Hough

Issued: Oct. 31, 1978

A cord holder for extension cords or the like comprising parallel side walls and interconnecting cross members disposed between the ends of the side walls around which the cord may be wrapped with reinforcing ribs at the junction of the side walls and the cross members; a handle connected to one of said side walls and reinforcing ribs at the junction of the handle and the side walls; keyways in one of the side walls to accommodate the head of a nail or the like for storage and clips on the other side wall to receive the enlarged ends of an extension cord.

U.S. Pat. No. 4,948,202

Inventor: James R Helseth

Issued: Aug. 14, 1990

A dispenser system for dispensing a plurality of twist-ties like closure devices arranged in side-by-side alignment and attached at a second end 61 in sheets. The attached second ends are crimped about a rod which is inserted in slots defined in side edges of dispenser. A plurality of sheets may selectively be inserted in dispenser. The dispenser also includes a cover and a tie alignment block. The individual ties have a series of transverse perforations, through the wire and proximate the wire to ensure ease of removal and ensure reference of the steel rule die utilized in fabricating the tie. Fabrication of the sheets includes taking a stock of uncut twist-tie material, advancing it into a cutting station utilizing a steel rule die. Advancing the material repeating the cutting step which forms the second end of the advanced sheet and then advancing the cut sheet to a crimping station.

U.S. Pat. No. 5,139,208

Inventor: Tracy H. Schooley

Issued: Aug. 18, 1992

A rack for storing flexible cords provides two spaced elongate sides interconnected inwardly adjacent each end by similar ends, each end defining a plurality of spaced grooves to positionally maintain coils of cord. A medial cross support communicates between the medial portions of the sides between the ends to prevent excessive sag of cord carried on the holder. Keyhole type grooves are defined in the rack to receive and releasably maintain end portions of cord stored on the rack. The side elements define cooperating sets of nubbins and indentations to align and positionally maintain a plurality of racks in stacked array. The rack is particularly adapted to formation from moldable plastic material.

U.S. Pat. No. 5,279,428

Inventor: Kuo-Hsing Lee

Issued: Jan. 18, 1994

A holder for a string of electric lights of the type having a plurality of lamps and corresponding lamp sockets connected at spaced intervals to electrical wiring. The holder is made up of connected upper and lower relatively thin elongated mounting plates along the sides of which are provided uniformly spaced alternating tabs and open ended slots. The upper and lower mounting plates and slots are aligned. Each one of the lower slots is for receiving wiring emanating from the base of a corresponding one of the lamp sockets and each one of the upper slots is for receiving a corresponding one of the lamps, the corresponding lamp sockets then being confined therebetween the upper and lower mounting plates. Two or more of the holders may be connected side by side.

U.S. Pat. No. 5,560,564

Inventor: David G. Maynard

Issued: Oct. 1, 1996

A cord organizer for storing an excess length of an electrical power cord including a first and second bundle strap assembly, connected by a central bundle strap connecting member, and a pair of cord clips, located on the bundle strap connecting member. Each bundle strap assembly includes a slotted strap insertable within the strap aperture of a cinch mechanism. The cinch mechanism has a screw-type barrel member that includes a cinch thread formed on an outer surface thereof. The barrel member is rotatable with respect to the strap aperture in a manner such that the cinch thread engages and urges the slotted strap through the strap aperture in a first predetermined direction when the barrel member is rotated in a clockwise direction and a second predetermined direction when the barrel member is rotated in the counter-clockwise direction. When a portion of the slotted strap is secured through the strap aperture, the cinch mechanism and slotted strap formed a closed bundle aperture that is utilized to contain and secure multiple sections of the power cord.

U.S. Pat. No. 5,847,787

Inventor: Berkeley D. Dunnavant, Jr

Issued: Dec. 8, 1998

A rack for storage of elongated resilient members, such as bungee cores, which have fasteners connected to opposite end regions of the elongated resilient members. The rack has a pair of opposed sides with first and second support members connected to an upper portion of each of the sides and a third support member connected to a lower portion of the sides. The first and second support members are disposed a predetermined distance apart. The first and second support members each have a predetermined width which is sufficient to be releasably engaged by the fasteners of the elongated resilient members. An elongated resilient member can be stored on the rack by engaging one of the fasteners on the first support member, pulling the resilient member around the third support member, and engaging the other fastener to the second support member.

U.S. Pat. No. 6,010,105

Inventor: Richard A. Davis

Issued: Jan. 4, 2000

A hanging device for suspending one or more implements which have either elongated generally straight handles or body portions. The device includes one or a plurality of rings or annular members each having a central open ear. Each ring is attached to one end of a length of flexible cord, string, cable and the like at a peripheral point of each ring. Each ring, when the other end of each cord is attached to an overhead support, will hang downwardly edgewise when not in use. An implement may be suspended for above ground or floor surface storage in a generally upright, freely swingable fashion by first passing the handle or body portion into the central open area of one ring, the central open area being somewhat larger than a diameter or thickness of the handle or body portion. By then allowing the handle or body portion to simply move by gravity into a generally upright orientation, the ring automatically moves into a canted position with respect to the handle or body portion and frictionally or penetratingly engages to hold and suspend the implement.

U.S. Pat. No. 6,099,060

Inventor: William J Towers

Issued: Aug. 8, 2000

A frame-like carrier for a plurality of various sized, stretchable, elastic bungee cords. The carrier has at least three spaced apart cross arms for supporting bungee cords in an organized and compact manner between any two of the cross arms. The cross arms are appropriately spaced such that commercially available sizes of bungee cords are supported on the carrier in a slightly stretched condition. Thus, the cords are supported under enough tension on the carrier to resist disengagement and maintain proper positioning, yet a small enough amount of tension to prevent an accidentally disengaged cord from creating a hazard as it snaps back into a non-tensioned condition.

U.S. Pat. No. 6,206,318

Inventor: Bruce A. Glass

Issued: Mar. 27, 2001

An apparatus for conveniently storing and retrieving cords associated with electronic devices or other power devices. The apparatus comprises a rectangular plate having opposed top and bottom edges and opposed left and right edges. In one embodiment, for each of the cords a pair of spaced-apart, opposed hooks is mounted on the plate near opposed edges, with each of the hooks comprising a stem having a first end in contact with the plate and a second, opposite end. An arm extends perpendicularly outwardly from the stem second end facing away from the other hook of its pair so cords can be wrapped around the pair. In another embodiment, the plate is long and narrow and the hooks are aligned in a row and facing the same direction so the cords can be laid in the row of hooks.

While these elastic cord storage devices may be suitable for the purposes for which they were designed, they would not be as suitable for the purposes of the present invention, as hereinafter described.

SUMMARY OF THE PRESENT INVENTION

A primary object of the present invention is to provide means to prevent entanglement of ends of a bungee style elastic cord.

Another object of the present invention is for means to house both ends of a bungee style cord within a cap.

Another object of the present invention is for means to have two individual compartments to house the needs of bungee style elastic cord hooks.

Yet another object of the present invention is to provide means to suspend the present invention from a post support or other vertical support means.

Another object of the present invention is to provide an elastic cord storage device that allows for ease of insertion and removal of the elastic cord hook.

One other object of the present invention is to provide a bungee style elastic cord storage device that holds cords in a efficient and organized manner.

One other object of the present invention is to provide a bungee style elastic cord storage device which can be used as packaging for sale of bungee cords.

Still yet another object of the present invention is to provide a bungee style elastic cord storage device which is inexpensive to manufacture.

Additional objects of the present invention will appear as the description proceeds.

The present invention overcomes the shortcomings of the prior art by providing means to prevent entanglement of one or a plurality of bungee style elastic cords. The present invention also provides means to efficiently store and retrieve bungee style elastic cords.

The present invention recites a storage device for elastic cords. The storage device includes a substantially hollow housing member having a first housing plate, a second housing plate parallel to and spaced apart from the first plate, and an integral side wall communicating between the edges of the first plate and the second plate extends peripherally along approximately three quarters of the two plates thereby forming a substantially enclosed central recess with an open bottom defining an access recess into the interior portion thereof. At least one partition plate is evenly spaced between the first plate and the second plate with the peripheral edges thereof permanently affixed to a central portion of the sidewall thereby dividing the central recess into a first compartment and a similarly proportioned second compartment. A support member in each compartment is integral with an upper medial portion of a plate surface within the compartment. The storage device further includes a device for suspending the housing from a substantially horizontal object. The support member may be wedge-shaped and has a substantially flat upper surface that tapers towards the access recess. The horizontal upper portion of the support member terminates to leave a gap between the furthest extended point thereof and the opposing plate.

To the accomplishment of the above and related objects, this invention may be embodied in the form illustrated in the accompanying drawings, attention being called to the fact, however, that the drawings are illustrative only, and that changes may be made in the specific construction illustrated and described within the appended claims.

BRIEF DESCRIPTION OF THE DRAWING FIGURES

In order that the invention be more fully understood, it will now be described, by way of example, with reference to the accompanying drawing in which:

FIG. 1A is a detail of the storage device connected to a bench wall;

Figure 1:
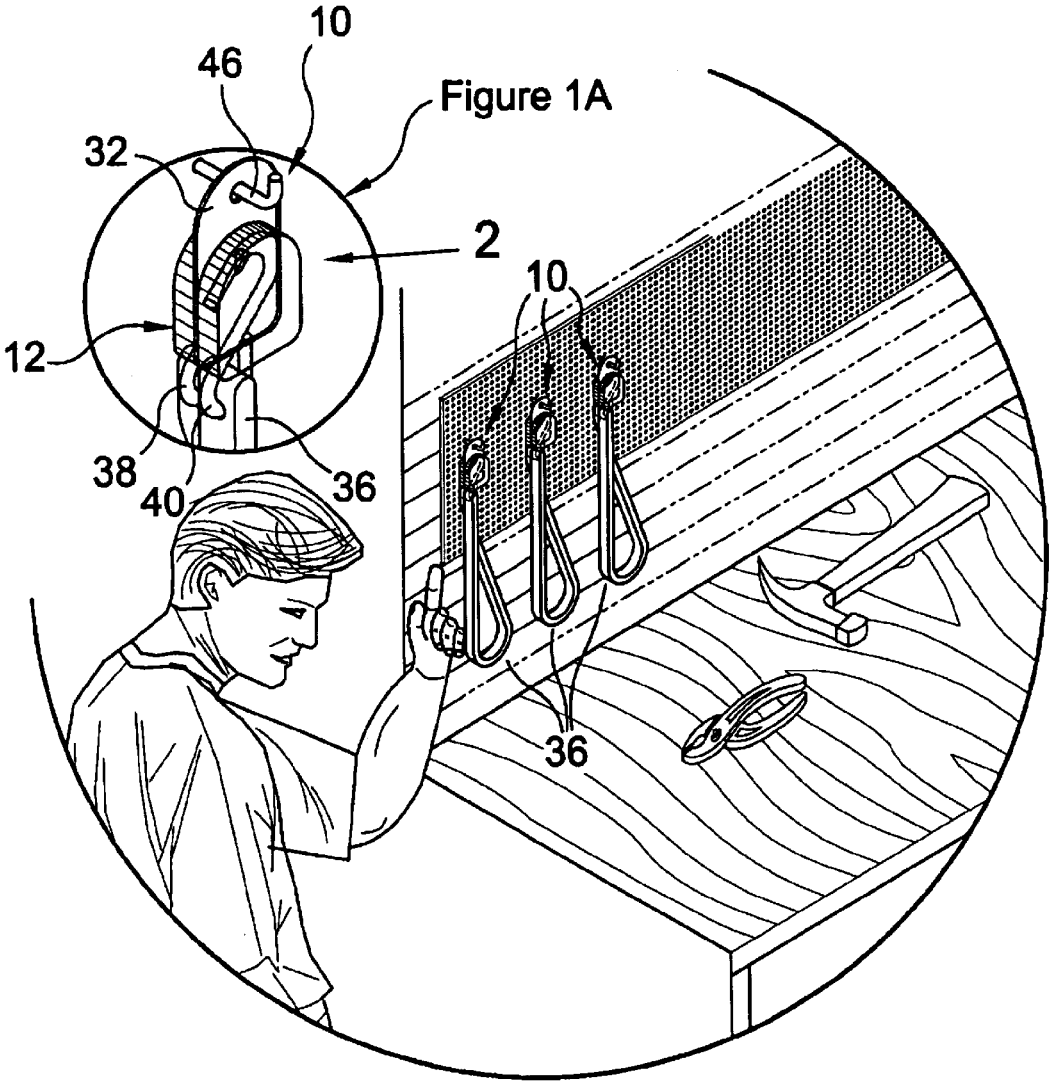
FIG. 1 is a perspective view of the present invention.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments.

Practitioners skilled in the art will recognize numerous other embodiments as well. For a definition of the complete scope of the invention, the reader is directed to the appended claims.

FIG. 1 is a perspective view of the present invention 10. Shown is an elastic cord storage device 10 being utilized on a work bench wall, with FIG. 1A showing a detail. The hooks 38, 40 of an elastic cord 36 are retained within the housing 12 of the elastic cord storage device 10 preventing entanglement of the elastic cords 36. The hooks 38, 40 at the distal end of the elastic cord storage device 10 allow the elastic cord 10 to be neatly stored.

Figure 2:
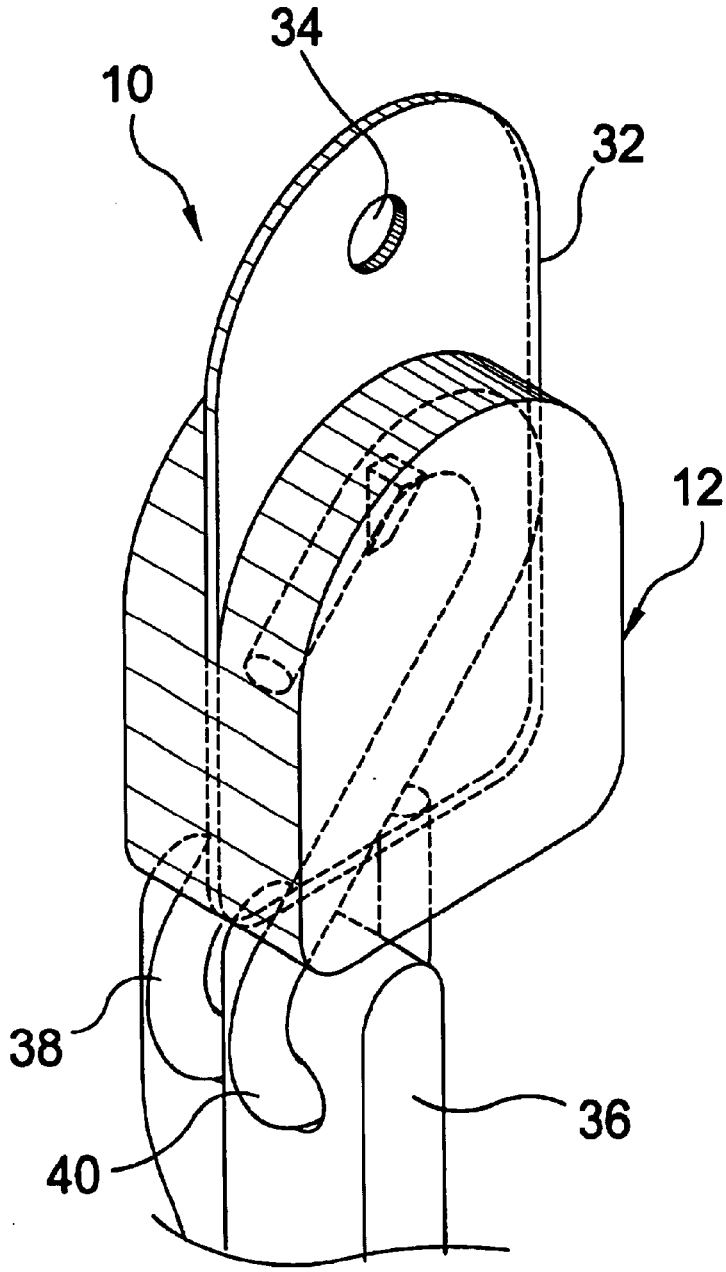
FIG. 2 is an isometric view of the present invention.

FIG. 2 is an isometric view of the present invention 10. Shown is an elastic cord 36 in storage with the hooks 38, 40 of the elastic cord 36 retained within the housing 12 of the elastic cord storage device 10 preventing entanglement of the elastic cords 36. The inner portion of the housing 12 is partitioned to form a first compartment 42 and a second compartment 44 for each end of the elastic cord 36. The elastic cord hooks 38, 40 are retained therein by support members 26 within the respective compartments 42, 44.

The support member is comprised of a resilient material that will allow a rod-like object such as an S-hook having a width greater than the gap to deform the support member sufficiently to allow the passage therethrough and to be maintained therein by the support member once the support member has returned to a static position until such time that adequate force is applied to the maintained object to redeform the support member.

Figure 3:
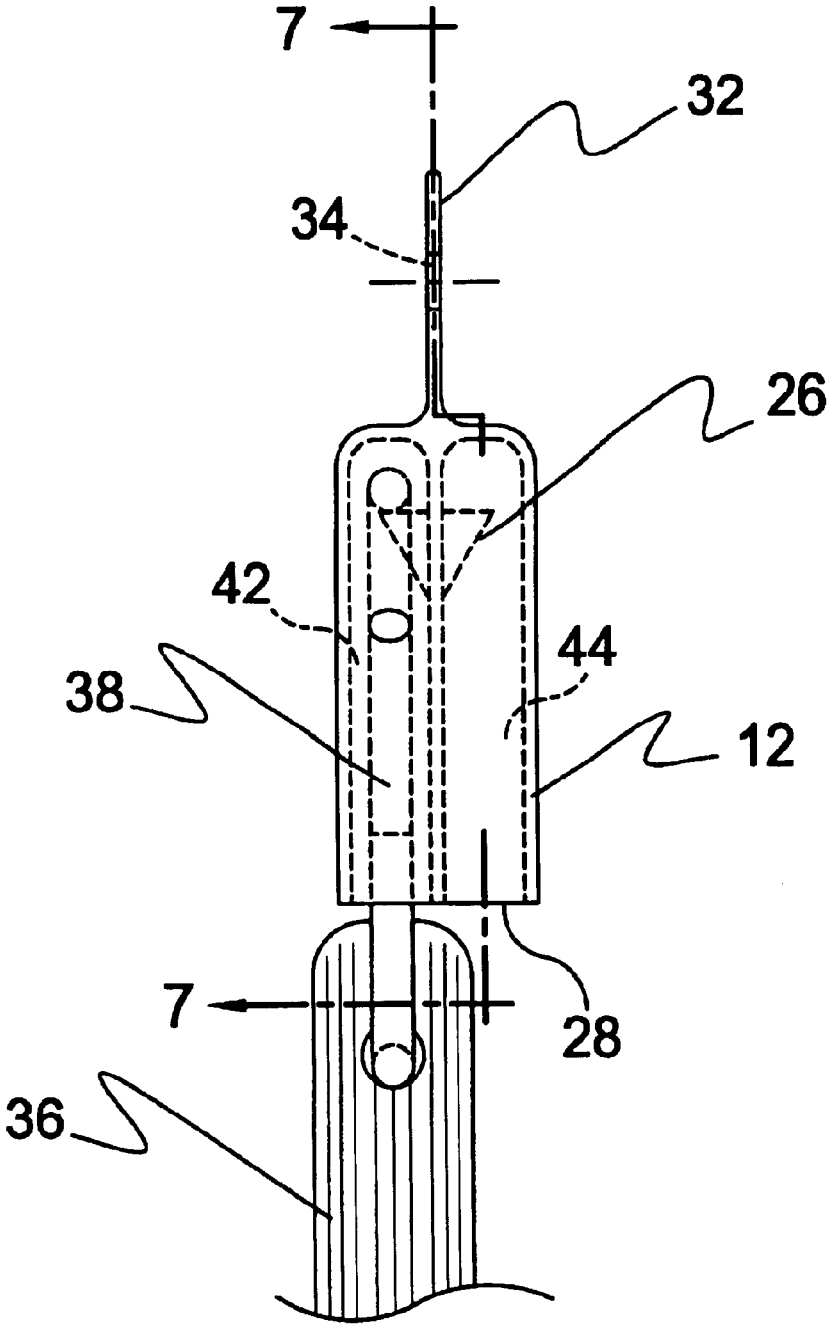
FIG. 3 is an end view of the present invention.

FIG. 3 is an end view of the present invention 10. Shown is an end view of the present invention 10 with an elastic cord 36 in storage. The hooks 38, 40 of an elastic cord 36 are retained in individual compartments 42, 44 of the elastic cord storage device 10 preventing entanglement of the elastic cords 36. The inner housing 12 is partitioned to form two separate compartments 42, 44 for each end of the elastic cord 36. The elastic cord hooks 38, 40 are supported by support members 26 within the housing 12.

Figure 4:
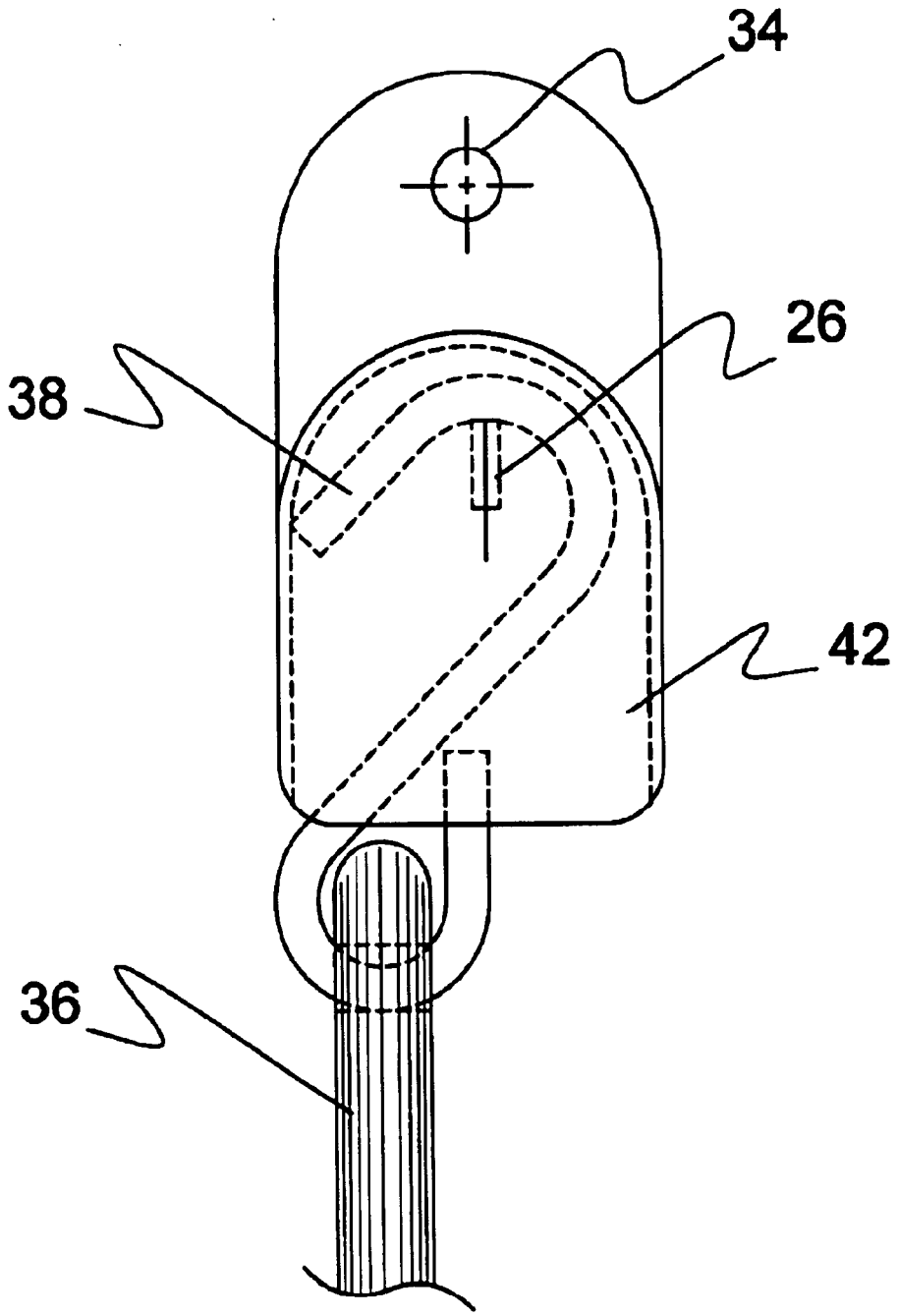
FIG. 4 is a side view of the present invention.

FIG. 4 is a side view of the present invention 10. Shown is a side interior view of the present invention 10 having the first elastic cord hook member 38 engaging the hook support member 26 of the present invention 10. The hook or hooks 38, 40 of an elastic cord are retained within the compartments 42, 44 of the elastic cord storage device 10 preventing entanglement. To retain the elastic cord 36, the elastic cord hooks 38, 40 are inserted through the access recess 28 of the housing and pushed up past the support member 26. The top edge of support member 26 keeps the elastic cord hook in position. The support member 26 are flexible to allow the elastic cord hooks 38, 40 to be pulled down for easy removal. The housing, support member and the partition wall are all fabricated of a resilient material.

Figure 5:
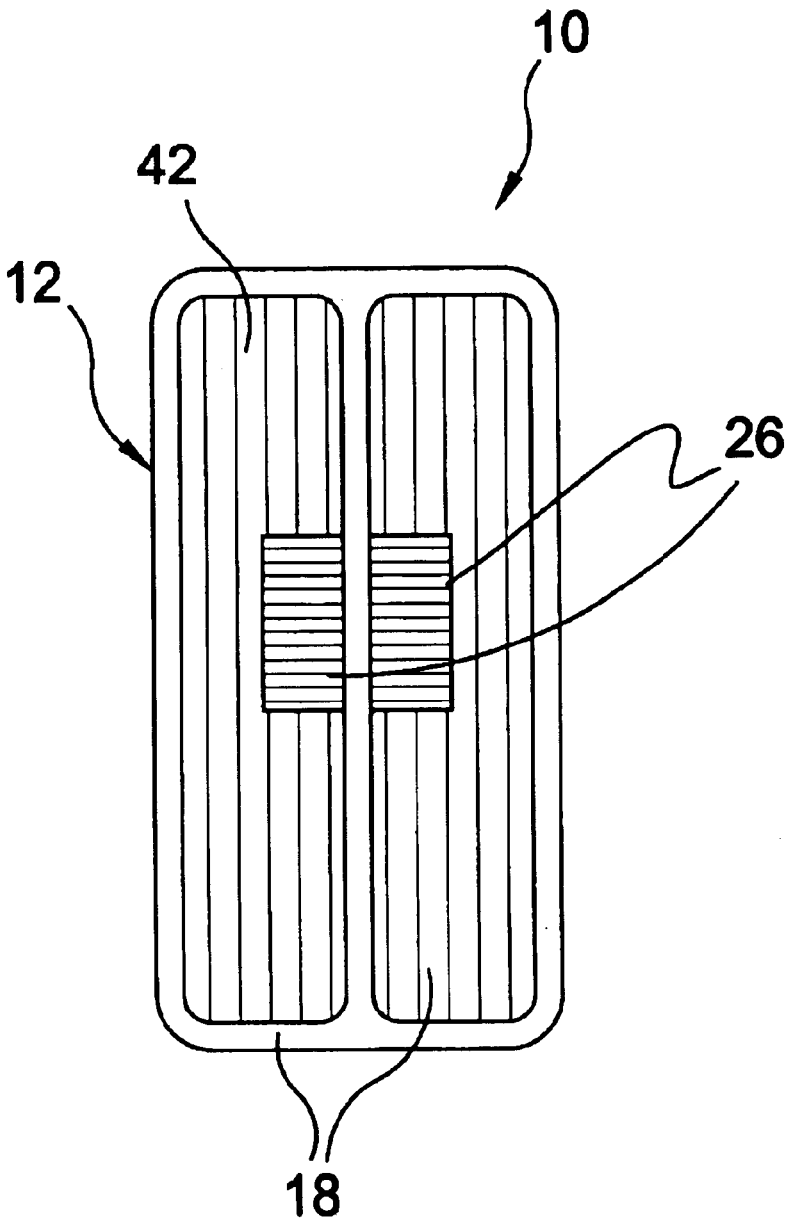
FIG. 5 is a bottom view of the present invention.

FIG. 5 is a bottom view of the present invention 10. Shown is a bottom interior view having an access recess 28 for inserting and extracting the hook members 38, 40. A support member 26 is molded within each compartment 42, 44 and extends partially across the compartment 42, 44. The support member 26 allows the hooks 38, 40 of an elastic code 36 to be retained within their respective compartments 42, 44 preventing entanglement of the hook members 38, 40 with additional elastic cords 36. Reference numeral 18 identifies the sidewall of the housing 12.

Figure 6:
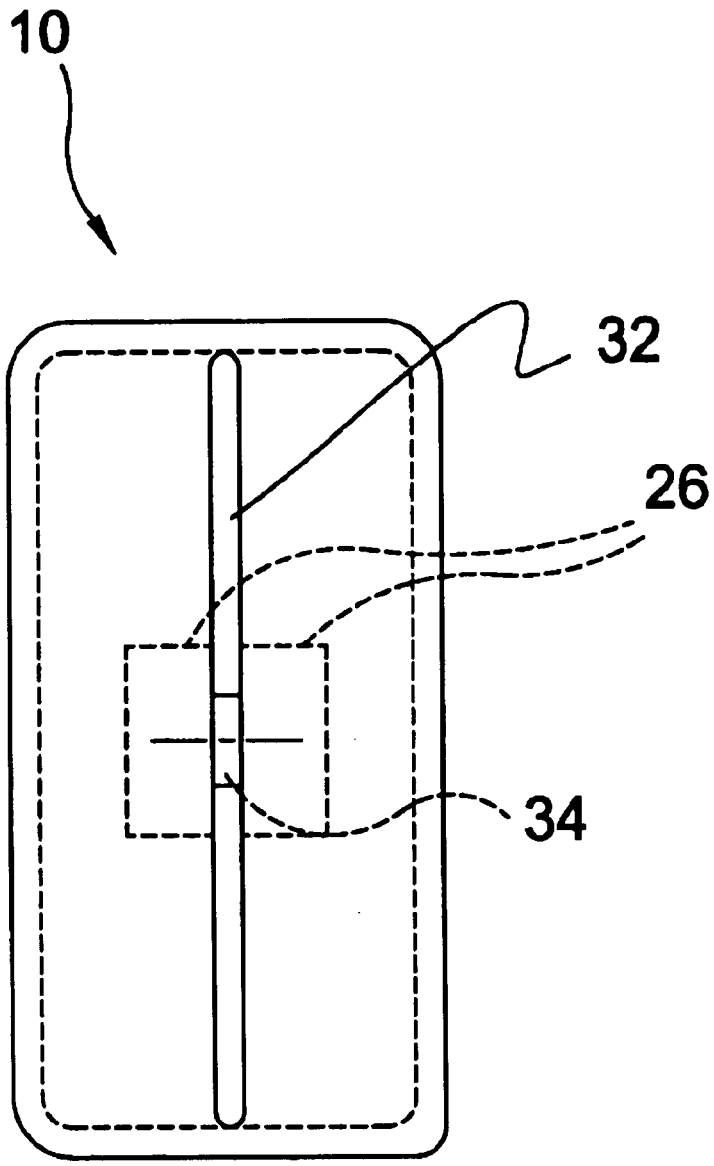
FIG. 6 is a top view of the present invention.

FIG. 6 is an interior view of the present invention 10 having two housing compartments 42, 44. The support member 26 extends from one wall and is spaced a predetermined distance from the opposing wall. The distance is determined as less than the width of the compartment. The housing 12 and support members 26 are preferably made from a malleable material such as deformable hand rubber or thermoplastics. A suspension plate 32 extending off the top of the housing 12 includes a suspension recess 34 that allows elastic cord storage device 10 to be suspended from a suspension support 46.

Figure 7:
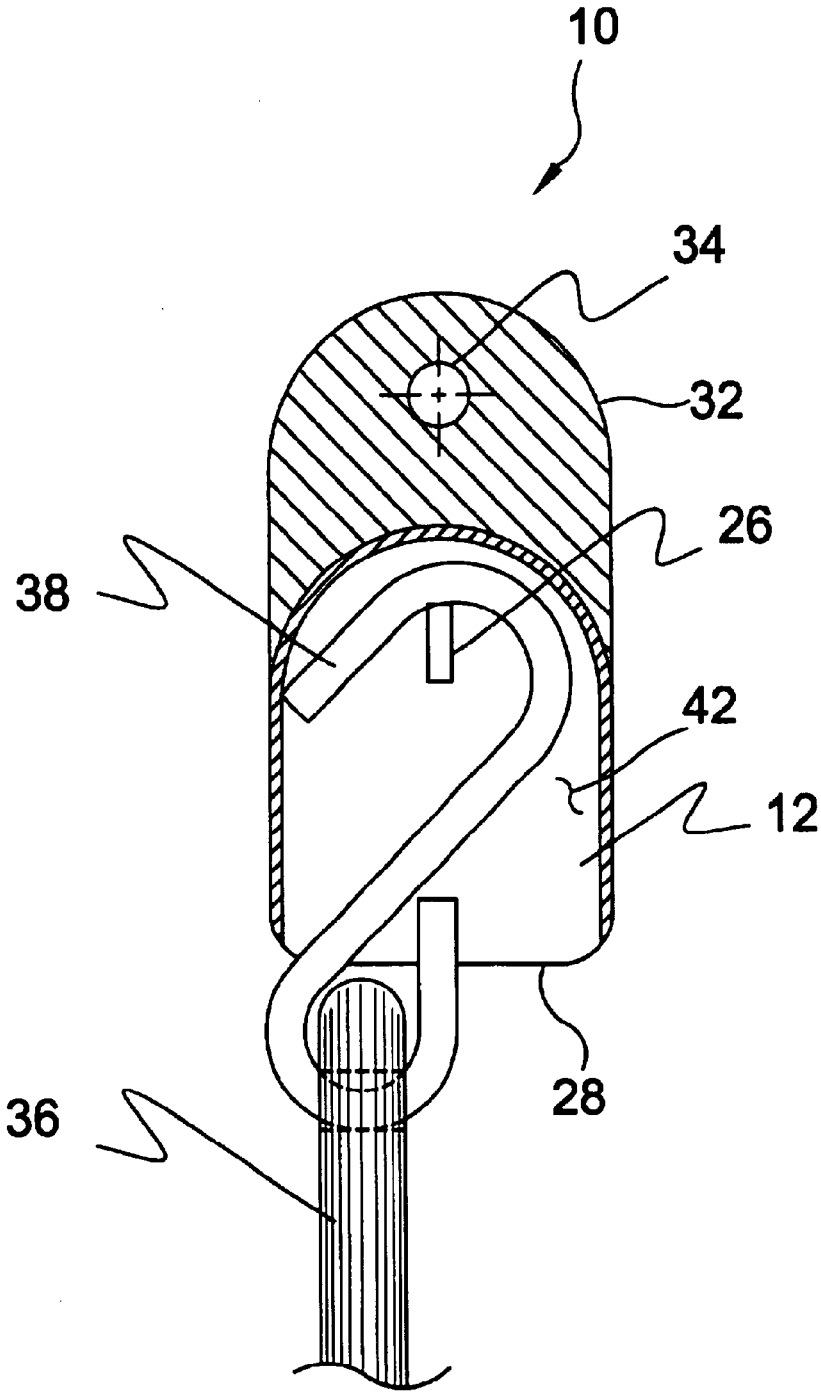
FIG. 7 is a sectional view of the present invention.

FIG. 7 is a sectional view of the present invention. Shown is a cross sectional view of the present invention 10 taken from FIG. 3 as indicated. The first hook 38 of an elastic cord 36 is retained within the first compartment 42 of the elastic cord storage device 10 preventing entanglement of the elastic cord hooks 38, 40. The elastic cord hooks 38, 40 are supported by support members 26 within the housing. The support member 26 and housing 12 are flexible to allow the elastic cord hooks 38, 40 to pulled out past the lip of the support member 26.

Figure 8:
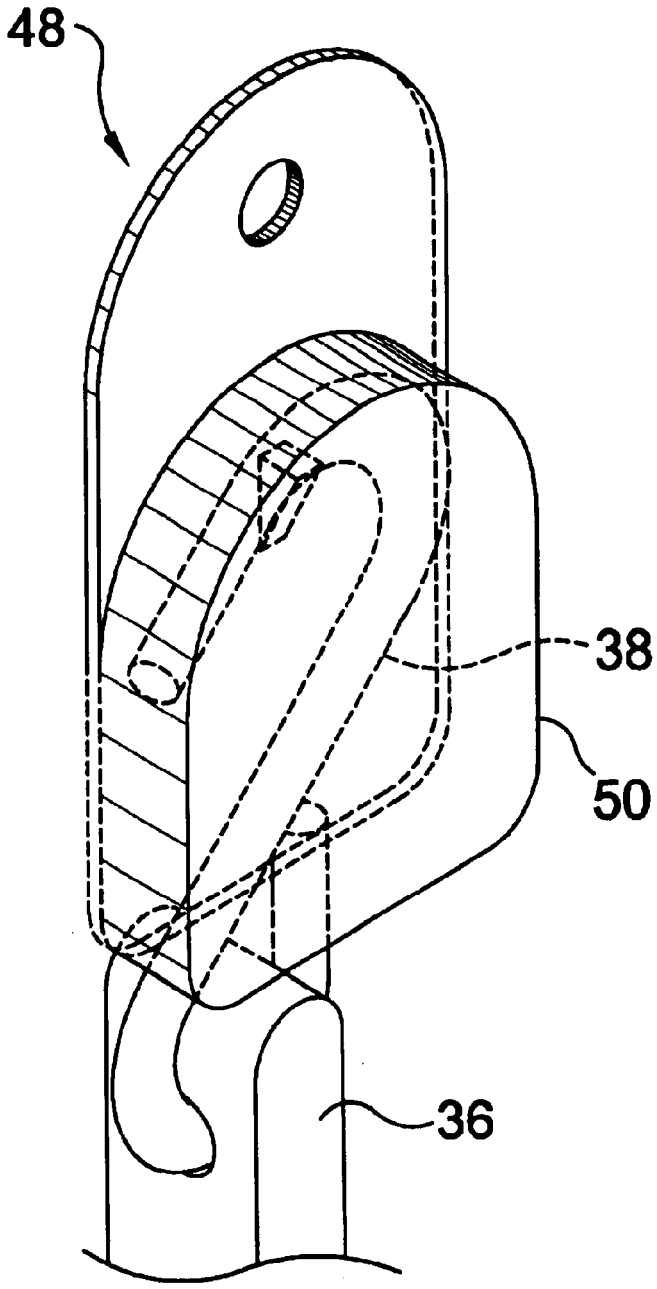
FIG. 8 is an isometric view of the present invention with embodiment.

FIG. 8 is an isometric view of the present invention 10 with a single compartment embodiment. With this embodiment of the present invention 48, the first hook 38 of the elastic cord 36 is inserted within the housing 50. The second hook 40 of the elastic cord 36 is allowed to hang freely. The support member 26 is formed to one inner side of the housing wall being spaced away from the opposing wall a distance less than the width of the compartment.

What is claimed is:

1. A storage device for elastic cords comprising:

a) a substantially hollow housing member having a first housing plate, a second housing plate parallel to and spaced apart from said first plate, and an integral side wall communicating between edges of said first plate and said second plate extending peripherally along approximately three quarters of the first and second housing plates thereby forming a substantially enclosed central recess with an open bottom defining an access recess into the interior portion of the housing member;

b) at least one partition plate evenly spaced between said first plate and said second plate with the peripheral edges thereof permanently affixed to a central portion of said sidewall thereby dividing said central recess into a first compartment and a similarly proportioned second compartment;

c) a support member in each compartment integral with an upper medial portion of a plate surface of said partition plate within the compartment; and d) means for suspending said housing from a substantially horizontal object.

2. A storage device for elastic cords as recited in claim 1, wherein said support member is wedge-shaped and has a substantially flat upper surface that tapers towards said access recess.

3. A storage device for elastic cords as recited in claim 2, wherein a horizontal upper portion of said support member terminates to leave a gap between the furthest extended point thereof and the opposing plate.

4. A storage device for elastic cords as recited in claim 1, wherein the support member is comprised of a resilient material that will allow a rod-like object such as an S-hook having a width greater than the gap to deform the support member sufficiently to allow for the passage therethrough and to be maintained therein by the support member once it has returned to its static position until such time that adequate force is applied to the maintained object to redeform the support member.

5. A storage device for elastic cords as recited in claim 1, wherein said housing, said support member and said partition wall are fabricated of a resilient material.

6. A storage device for elastic cords as recited in claim 5, wherein said resilient material is a deformable hard rubber.

7. A storage device for elastic cords as recited in claim 1, wherein the resilient material is a malleable thermoplastic.

8. A storage device for elastic cords as recited in claim 1, wherein said suspension means comprises a suspension plate extending vertically from the uppermost portion of said housing member and a suspension recess extending therethrough for a hanger element.

9. A storage device for elastic cords comprising:

a) a resilient housing member having a hollow interior enclosed on the top and sides and open on the bottom;

b) a resilient support member protruding from an interior portion of said housing member;

c) means for suspending said housing member; and d) a first hook member of an elastic cord is inserted through said open bottom of said housing member where it is slightly obstructed by said support member until adequate pressure is applied to deform said support member to allow passage therethgouh and said first hook member will then be refused egress therefrom during storage by said support member until sufficient downward pressure is applied thereto thus forcing said first hook member to deform said support member to allow for the removal therefrom for use.

10. A storage device for elastic cords as recited in claim 9, wherein said first hook member of the elastic cord is retained within said housing member by said support member during storage while a second end of the elastic cord hangs freely.

11. A storage device for elastic cords as recited in claim 9, wherein said suspension means comprises a suspension plate extending vertically from the uppermost portion of said housing member and a suspension recess passing therethrough.

* * * * *